US011158146B2

(12) United States Patent
Cahill

(10) Patent No.: US 11,158,146 B2
(45) Date of Patent: Oct. 26, 2021

(54) INTERIOR DOOR HANDLE EMERGENCY LOCKDOWN APPARATUS, SYSTEM, MOBILE APPLICATION, AND METHOD THEREOF

(71) Applicant: Jeff Cahill, Castle Rock, CO (US)

(72) Inventor: Jeff Cahill, Castle Rock, CO (US)

( * ) Notice: Subject to any disclaimer, the term of this patent is extended or adjusted under 35 U.S.C. 154(b) by 508 days.

(21) Appl. No.: 16/259,065

(22) Filed: Jan. 28, 2019

(65) Prior Publication Data

US 2019/0236876 A1 Aug. 1, 2019

Related U.S. Application Data

(60) Provisional application No. 62/622,826, filed on Jan. 27, 2018.

(51) Int. Cl.

| | |
|---|---|
| ***G07C 9/00*** | (2020.01) |
| ***E05B 47/00*** | (2006.01) |
| *G07C 9/20* | (2020.01) |

(52) U.S. Cl.

CPC ..... *G07C 9/00817* (2013.01); *E05B 47/0012* (2013.01); *G07C 9/00896* (2013.01); *E05B 2047/0053* (2013.01); *E05B 2047/0067* (2013.01); *G07C 9/20* (2020.01); *G07C 2009/00841* (2013.01)

(58) Field of Classification Search

CPC .. G07C 9/00817; G07C 9/00896; G07C 9/20; G07C 2009/00841; G07C 9/00944; E05B 47/0012; E05B 2047/0053; E05B 2047/0067; E05B 2047/005; E05B 2047/0095; E05B 17/22

USPC ..... 70/257, 277, 280–283, 278.1, 278.7, 70/279.1; 292/144; 340/5.23, 5.24, 5.61, 340/5.64

See application file for complete search history.

(56) References Cited

U.S. PATENT DOCUMENTS

| | | | | | |
|---|---|---|---|---|---|
| 3,933,382 | A * | 1/1976 | Counts | E05B 47/0012 | 292/144 |
| 5,061,923 | A * | 10/1991 | Miller | G07C 9/00698 | 340/5.31 |
| 5,487,290 | A * | 1/1996 | Miller | E05B 17/2084 | 292/142 |
| 7,010,947 | B2 * | 3/2006 | Milo | E05B 47/0012 | 292/144 |
| 10,352,067 | B2 * | 7/2019 | Cahill | G07C 9/00174 | |
| 2013/0139561 | A1 * | 6/2013 | Parto | G07C 9/00944 | 70/278.7 |

* cited by examiner

*Primary Examiner* — Lloyd A Gall
(74) *Attorney, Agent, or Firm* — The Iwashko Law Firm, PLLC; Lev Ivan Gabriel Iwashko

(57) ABSTRACT

An electronic lockset mounted on a door, the electronic lockset including a lock comprising at least one of a latch bolt and a deadbolt to prevent the door from opening when the lock is in a locked state, an interior handle to open the door when the lock is in an unlocked state, a sensor to sense a manipulation of the interior handle, a printed circuit board (PCB) to receive information sensed by the sensor regarding the manipulation of the interior handle, and a motor to move the at least one of the latch bolt and the deadbolt in response to a signal received by the PCB directed to the information regarding the manipulation of the interior handle.

10 Claims, 3 Drawing Sheets

1000

INTERIOR DOOR HANDLE EMERGENCY LOCKDOWN APPARATUS, SYSTEM, MOBILE APPLICATION, AND METHOD THEREOF

CROSS REFERENCE TO RELATED APPLICATION

This application claims benefit of, and therefore, incorporates by reference, U.S. provisional patent application Ser. No. 62/622,826, entitled "Interior Door Handle Emergency Lockdown Apparatus, System, Mobile Application, and Method Thereof," which was filed on Jan. 27, 2018.

FIELD

The present general inventive concept relates to an electronic door lockset, and more particularly, to an electronic door lockset that includes a handle-initiated lockdown functionality, and more specifically, an electronic door lockset that locks in response to a manipulation of an interior handle of the electronic door lockset.

DESCRIPTION OF THE RELATED ART

Conventional electronic door locks allow a user to use regular key or digital keys, such as dongles (e.g., key fobs), cards, chip-cards, mobile devices, keypads, touch plates, cameras, and other types of wireless communication objects and/or devices in order to lock and/or unlock the conventional electronic locks. In other words, the conventional electronic door locks may include card readers, chip readers, sensors, keypads, scanners, and other types of wireless devices that interact with the digital keys in order to lock and/or unlock the conventional electronic locks.

However, in emergency situations, such as a terrorist takeover or intruder alert scenario, a user may not have a regular key or an electronic key to a lock the door to prevent the intruder from entering a home, building, or room in which the user is located.

Schools do not typically have sufficient funding for extravagant security systems, so they typically do not replace mechanical classroom locks with electro-mechanical locks. However, in order to lock or unlock a door having the mechanical lock, a user must be on the outside or hallway side of the door to lock or unlock the door with a key.

As such, on Sep. 14, 2012, a teacher was shot attempting to lock a door in this manner in the Sandy Hook massacre in Newtown, Conn. As a result, fire marshals (i.e. in Denver, Colo., etc.) have begun mandating standard turn-button mechanical lock functions on the inside of classroom doors. This is a terrible solution because kids can lock the teacher out of a classroom by simply turning a turn-button inside the classroom which locks the outside lever. Therefore, fire marshals have mandated that teachers wear a lanyard with a key attached so they don't get locked out of their classrooms by students . . . again a poor solution, especially if a teacher takes the lanyard off, etc.

As such, there is a need for a keyless method of performing a lockdown of an electronic lockset, especially in the case of an emergency.

SUMMARY

The present general inventive concept provides a lockset having a handle-activate lockdown functionality.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an electronic lockset mounted on a door, the electronic lockset including a lock comprising at least one of a latch bolt and a deadbolt to prevent the door from opening when the lock is in a locked state, an interior handle to open the door when the lock is in an unlocked state, a sensor to sense a manipulation of the interior handle, a printed circuit board (PCB) to receive information sensed by the sensor regarding the manipulation of the interior handle, and a motor to move the at least one of the latch bolt and the deadbolt in response to a signal received by the PCB directed to the information regarding the manipulation of the interior handle.

The manipulation of the interior handle may include at least one of the interior handle being turned and held for a predetermined time period, the interior handle being moved to a particular position, and the interior handle being turned a predetermined number of times in a particular sequence.

The foregoing and/or other features and utilities of the present general inventive concept may also be achieved by providing system to perform a lockdown of a door, the system including an electronic lockset installed on the door, the lockset comprising a handle and at least one of a latch and a bolt, and a mobile device to communicate with the electronic lockset, such that the mobile device sends instructions to the electronic locket to program the electronic lockset to lock the at least one of the latch and the lock in response to a manipulation of the handle.

The predetermined manipulation of the handle may include at least one of moving the handle in a particular direction a predetermined number of times, holding the handle down in a door-opening position for a predetermined amount of time, and turning the handle to a particular position.

The instructions may be sent from the mobile device to the electronic lockset in response to the mobile device being brought within a predetermined proximity of the lockset.

The foregoing and/or other features and utilities of the present general inventive concept may also be achieved by providing an electronic lockset mounted on a door, the electronic lockset including a lock including at least one of a latch bolt and a deadbolt to prevent the door from opening when the lock is in a locked state, an interior handle to open the door when the lock is in an unlocked state, and a motor to move the at least one of the latch bolt and the deadbolt from an unlocked position to a locked position in order to place the lock in the locked state in response to a manipulation of the interior handle.

The predetermined manipulation of the handle may include at least one of moving the handle in a particular direction a predetermined number of times, holding the handle down in a door-opening position for a predetermined amount of time, and turning the handle to a particular position.

The electronic lockset may further include a sensor to sense the manipulation of the interior handle, and a printed circuit board (PCB) to receive information sensed by the sensor regarding the manipulation of the interior handle and to send a signal to the motor corresponding to the received information.

The motor may move the at least one of the latch bolt and the deadbolt from the unlocked position to the locked position in response to the signal received from the PCB.

The predetermined manipulation of the handle may include at least one of moving the handle in a particular direction a predetermined number of times, holding the handle down in a door-opening position for a predetermined amount of time, and turning the handle to a particular position.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Various example embodiments will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like or similar elements throughout the description of the figures.

It will be understood that when an element is referred to as being "connected" or "coupled" to another element, it can be directly connected or coupled to the other element or intervening elements may be present in contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "Including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
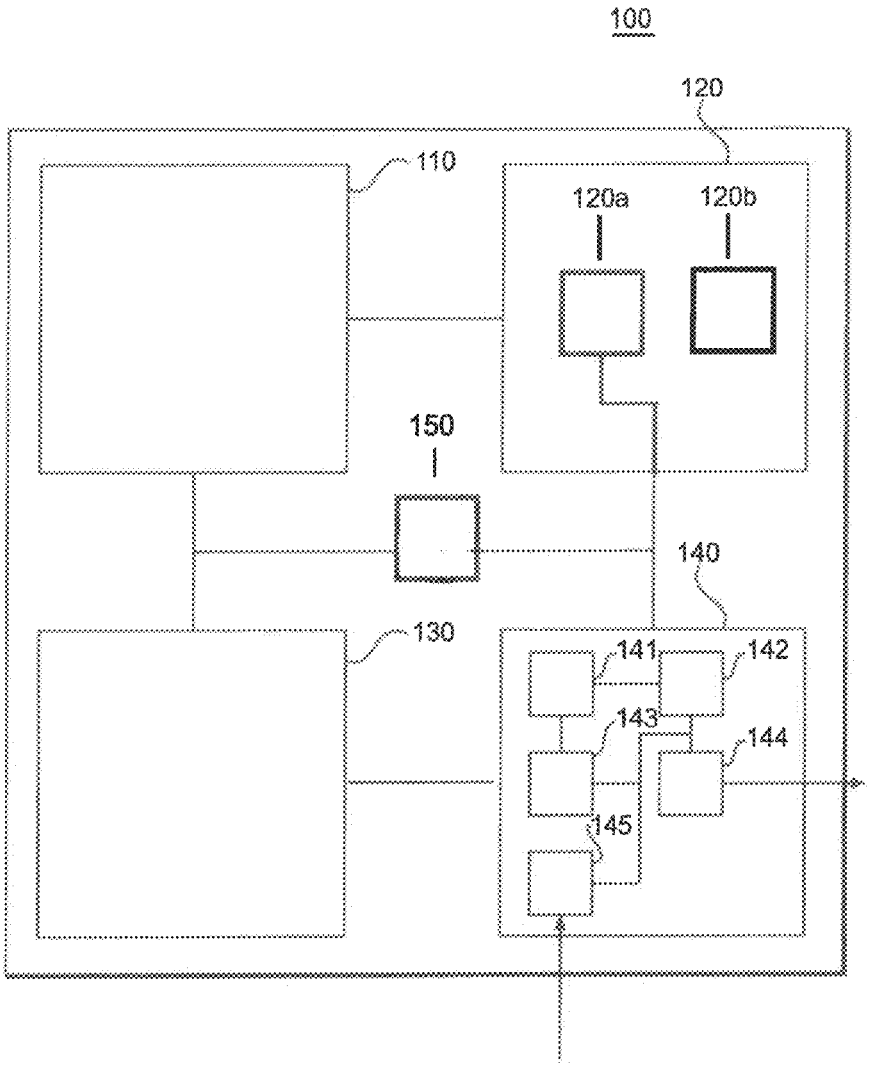
FIG. 1 illustrates a block diagram of a lockset 100 to implement a lockdown functionality, according to an exemplary embodiment of the present general inventive concept.

FIG. 1 illustrates a block diagram of a lockset 100 to implement a lockdown functionality, according to an exemplary embodiment of the present general inventive concept.

The lockset 100 may be an electronic lockset, an online lockset, and an offline lockset, or any combination thereof, but is not limited thereto. Also, the lockset 100 may be a combined lock and handle set, or may include the lock portion separately from the handle portion. The lockset 100 may be mounted on a door 1, but is not limited thereto.

The lockset 100 may include a lock 110, a handle 120, a sensor 130, a printed circuit board (PCB) 140, and a motor 150, but is not limited thereto.

The lock 110 may be at least one of a knob lock, latch lock, a lever handle lock, a deadbolt lock, a mortise lock, and keyless entry lock, but is not limited thereto. The lock may be unlocked by an electronic key, such as a key card, chip card, fob, etc., or may alternatively be unlocked by a regular, non-electronic, key. Furthermore, other mechanisms may be used to lock and/or unlock the lock 110, such as mobile devices, keypads, touch plates, cameras, and other types of wireless communication objects and/or devices.

The handle 120 may be at least one of a lever, a handle, a push plate, and a door pull, but is not limited thereto. When the lock 110 is in an unlocked state, then a user may use the handle 120 to open the door 1. When the lock 110 is in a locked state, then the user may be required to first use a key, electronic or non-electronic, to open the lock 110 before the door can be opened. The handle 120 may be provided on an exterior surface of the door 1, and also an interior surface of the door 1. As such, although both an interior handle **120*a* and an exterior handle 120*b* may open the door 1 when turned, the interior handle 120*a* may be disconnected from (i.e., independently movable from) the exterior handle 120*b*. As such, even when the lock 110 is in a locked state, the interior handle 120*a* and the exterior handle 120*b*** may still move (i.e., be free-wheeling).

The sensor 130 may be at least one of a pressure sensor, a force sensor, a density sensor, a level sensor, a proximity sensor, a tilt sensor, a presence sensor, a position sensor, an angle sensor, a displacement sensor, a distance sensor, a speed sensor, an acceleration sensor, an optical sensor, a light sensor, an imaging sensor, an electric current sensor, an electric potential sensor, a magnetic sensor, an acoustic sensor, a sound sensor, and a vibration sensor, but is not limited thereto.

The sensor 130 may be provided in plurality, and may include various combinations of the above sensor-types. For example, a tilt sensor may sense whether the interior handle **120*a* has been turned by monitoring the interior handle 120*a* or components connected thereto. As such, the sensor 130 may be disposed on the interior handle 120*a* itself, or inner components thereof, such as a rotation rod, a positioning ring, a rose, a cam, or any other portion of the interior handle 120*a*. As such, since the interior handle 120*a* may move independently from the exterior handle 120***b*, a turning of the exterior handle 120*a* would not cause the sensor 130 to move.

The sensor 130 may sense whether the interior handle 120*a* has been (1) manipulated in a certain pattern, (2) placed in a particular position, or (3) turned and held down for a particular period of time. Therefore, for example, if the sensor 130 senses that the interior handle 120*a* has been turned and held for 3 seconds, a signal may be sent to the PCB 140 such that the PCB 140 may control the lockset 100 to activate a lockdown functionality. If the lockdown functionality is activated, a latch bolt and/or a dead bolt of the lockset 100 may automatically move from an unlocked position to a locked position.

Another sensor 130 (a magnetic sensor for example) may be included to sense whether the door 1 is actually in an open position, and therefore, the another sensor 130 may prevent the lockdown functionality from being able to be performed if the door 1 is in the open position.

The PCB 140 may include a storage unit 141, a processor 142, a controller 143, a transceiver 144, and a receiver 145, but is not limited thereto. Furthermore, the PCB 140 may include the sensor 130 as an integrated component of the PCB 140, or alternatively, may be provided separately from the PCB 140 and connected via a wire or wirelessly, thereto.

The storage unit 141 may include a memory storage device that stores information received from the sensor 130. As such, the storage unit 141 may be used to store information regarding a programming of the lockset 100. More specifically, if the lockset 100 is programmed to require a 3-second hold-down of the handle 120 in order to initiate a lockdown functionality, then the storage unit 141 may store this information for later use by the processor 142.

The processor 142 may include logic that determines, based on information received from the sensor 130, that at least one of, or a combination of, various manipulations of the interior handle 120*a* have occurred. More specifically, the logic of the processor 142 may determine, based on the information received from the sensor 130, whether the interior handle 120*a* has been (1) manipulated in a certain pattern, (2) placed in a particular position, or (3) turned and held down for a particular period of time.

The controller 143 may control mechanisms to move the lock 110 from an unlocked position to a locked position, based on a signal received from the processor 142. More specifically, in response to the sensor 130 sensing that the handle 120 has been turned and held for a particular period of time, such as 3 seconds for example, processor 142 may send a signal to the controller 143, such that the controller 143 activates mechanisms to move the lock 110 from an unlocked position to a locked position.

The RF transceiver 144 may send information to a mobile device regarding a state of the lock 110. The RF transceiver 144 may also send other information to various other devices.

The RF receiver 145 may receive programming information for the lockset 100 from a mobile device.

The motor 150 provide motorized power to automatically actuate the lock 110, such that the lock 110 (including latches and/or bolts) may move from an unlocked position to a locked position.

Figure 2:
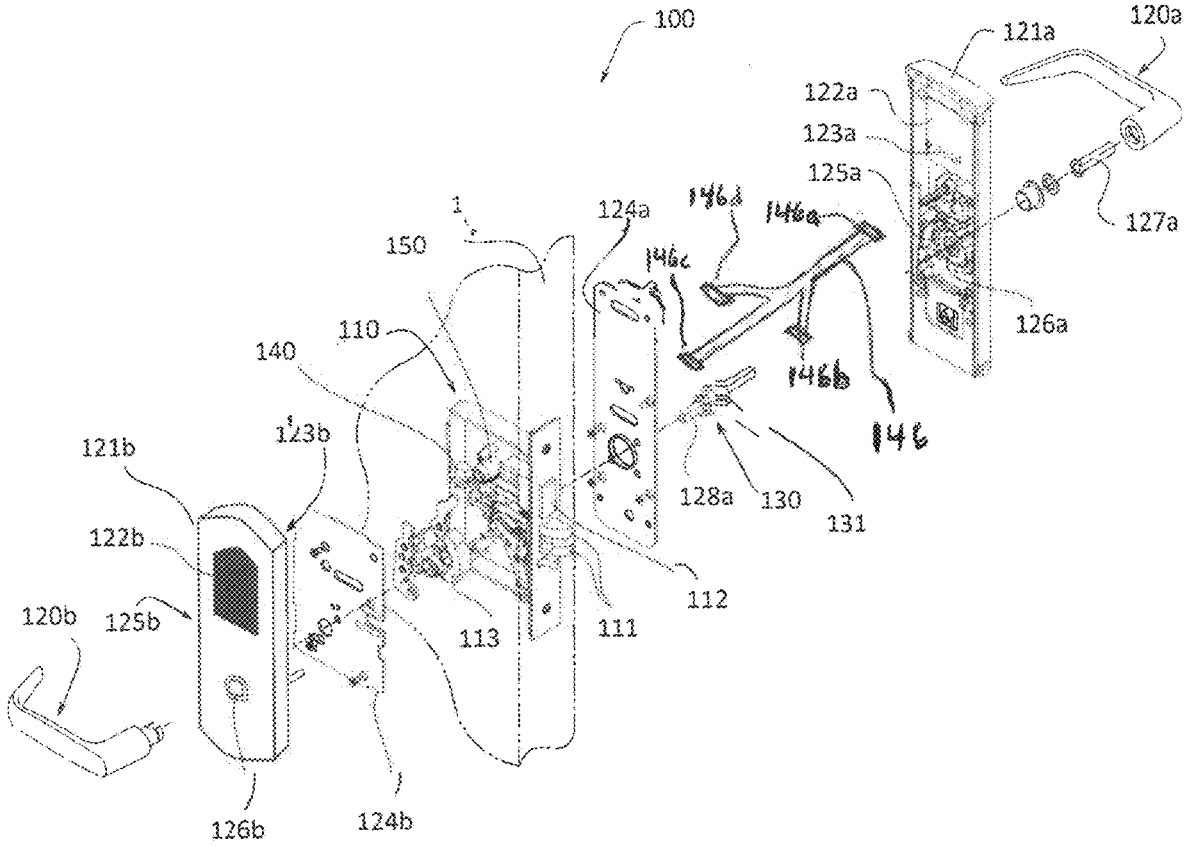
FIG. 2 illustrates an exploded view of the lockset 100, according to an exemplary embodiment of the present general inventive concept

FIG. 2 illustrates an exploded view of the lockset 100, according to an exemplary embodiment of the present general inventive concept.

Referring to FIGS. 1 and 2, the lockset 100 may include the lock 110, the handle 120, the sensor 130, the printed circuit board (PCB) 140, and the motor 150, but is not limited thereto. Descriptions and details of the lock 110, the handle 120, the sensor 130, the printed circuit board (PCB) 140, and the motor 150 will be omitted, as they have already been described above with regard to FIG. 1.

Referring to FIG. 2, the handle 120 may actually comprise separate and independently movable handles, specifically, the interior handle 120*a* and the exterior handle 120*b*.

The interior handle 120*a* may be connected to a first side of the lock 110 via an inside spindle 127*a* that travels through a hole 126*a* of a drive plate 125*a* of an inside housing assembly 121*a*, such that the inside spindle 127*a* is also connected to a spindle 128*a* that may travel through a hole of a protective cover plate 124*a* until it is connected to the lock 110. As such, when the interior handle 120*a* is turned, the spindle 128*a* may also turn, thereby causing a latch bolt 111 of the lock 110 to retract within a body of the lock 110 to allow the door 1 to be opened.

An electronic reader 122*a* may be disposed on the inside housing assembly 121*a*, and may include circuitry to sense whether an electronic key or a mobile device is within a certain proximity of the electronic reader 122*a*. As such, the electronic reader 122*a* may allow a user to program the lockset 100, or alternatively, to lock or unlock the lock 100 using the electronic key or the mobile device. The electronic reader 122*q* may include at least one battery disposed thereinside to provide power thereto.

The exterior handle 120*b* may be connected to a second side of the lock 110 by having a portion of the exterior handle 120*b* enter a hole 126*b* of an exterior housing assembly 121*b*, then may enter a hole in a protective cover plate 124*b*, until the exterior handle 120*b* is connected to a mortise latch hub 113 that is connected to the lock 110. As such, when the exterior handle 120*b* is turned, the mortise latch hub 113 engages with the latch bolt 111 of the lock 110, which may then retract to allow the door 1 to be opened.

An electronic reader 122*b* may be disposed on the exterior housing assembly 121*b*, and may include circuitry to sense whether an electronic key or a mobile device is within a certain proximity of the electronic reader 122*b*. As such, the electronic reader 122*b* may allow a user to lock or unlock the lock 110 using the electronic key or the mobile device. The electronic reader 122*b* may include at least one battery disposed thereinside to provide power thereto.

The sensor 130 may be connected directly to the spindle 128*a*. Since the spindle 128*a* turns in response to the interior handle 120*a* turning, the sensor 128*a* may sense a turning of the interior handle 120*a* when the interior handle 120*a* is turned. Alternatively, the sensor 130 may be attached to any components connected to the interior handle 120*a*, such that a turning and/or a positioning of the interior handle 120*a* may be sensed by the sensor 130.

An electrical ribbon 146 may be used to connect various components within the lockset 100 to the PCB 140. For example: (1) the electrical ribbon 146 may include a first connector 146*a* disposed at a first end of the electrical ribbon 146, which is connected to an electronic reader connector 123*a* of the electronic reader 122*a*; (2) the electrical ribbon 146 may include a second connector 146*b* disposed at a second end of the electrical ribbon 146, which is connected to sensor connector 131 of the sensor 130; (3) the electrical ribbon 146 may include a third connector 146*c* disposed at a third end of the electrical ribbon 146, which is connected to an electronic reader connector 123*b* of the electronic reader 122*b*; and (4) the electrical ribbon 146 may include a fourth connector 146*d* disposed at a fourth end of the electrical ribbon 146, which is connected to the PCB 140. As such, the electronic reader 122*a*, the electronic reader 122*b*, and the sensor 130 may all be connected to the PCB 140. Alternatively, the electronic reader 122*a*, the electronic reader 122*b*, the sensor 130, to the PCB 140, and the motor 150 may all be communicably connected to each other using any aforementioned wireless method.

The PCB 140 may also be connected to the motor 150. The PCB 140 may selectively send a signal to actuate the motor 150, such that the motor 150 causes the latch bolt 111 to lock and/or unlock (i.e., be non-retractable and/or retractable). The PCB 140 also may selectively send a signal to actuate the motor 150, such that the motor 150 causes a deadlock 112 to lock and/or unlock (i.e., extent and/or retract).

To initiate the lockdown functionality of the lockset 100, as mentioned above, the interior handle 120*a* may be used as a lockdown initiator. More specifically, to initiate the lockdown functionality, the interior handle 120*a* may be: (1) manipulated in a certain pattern, (2) placed and/or moved to a particular position, or (3) turned and held down for a particular period of time.

If one or a combination of the above manipulations of the interior handle 120*a* are performed, the sensor 130, which may be connected to the spindle 128*a*, may sense a turning and/or a positioning of the interior handle 120*a*. In response to the sensor 130 sensing the turning and/or the positioning of the interior handle 120*a*, the sensor 130 may then send a signal to the PCB 140, which may then send a signal to the motor 150 to move at least one of the latch bolt 111 and the deadlock 112. In other words, a predetermined and/or programmed manipulation of the interior handle 120*a* may cause the latch bolt and/or the deadlock 112 to lock, thereby causing the lockset 100 to be in a lockdown mode.

As such, a key is not necessary to lock the lockset 100 in an emergency situation.

Figure 3:
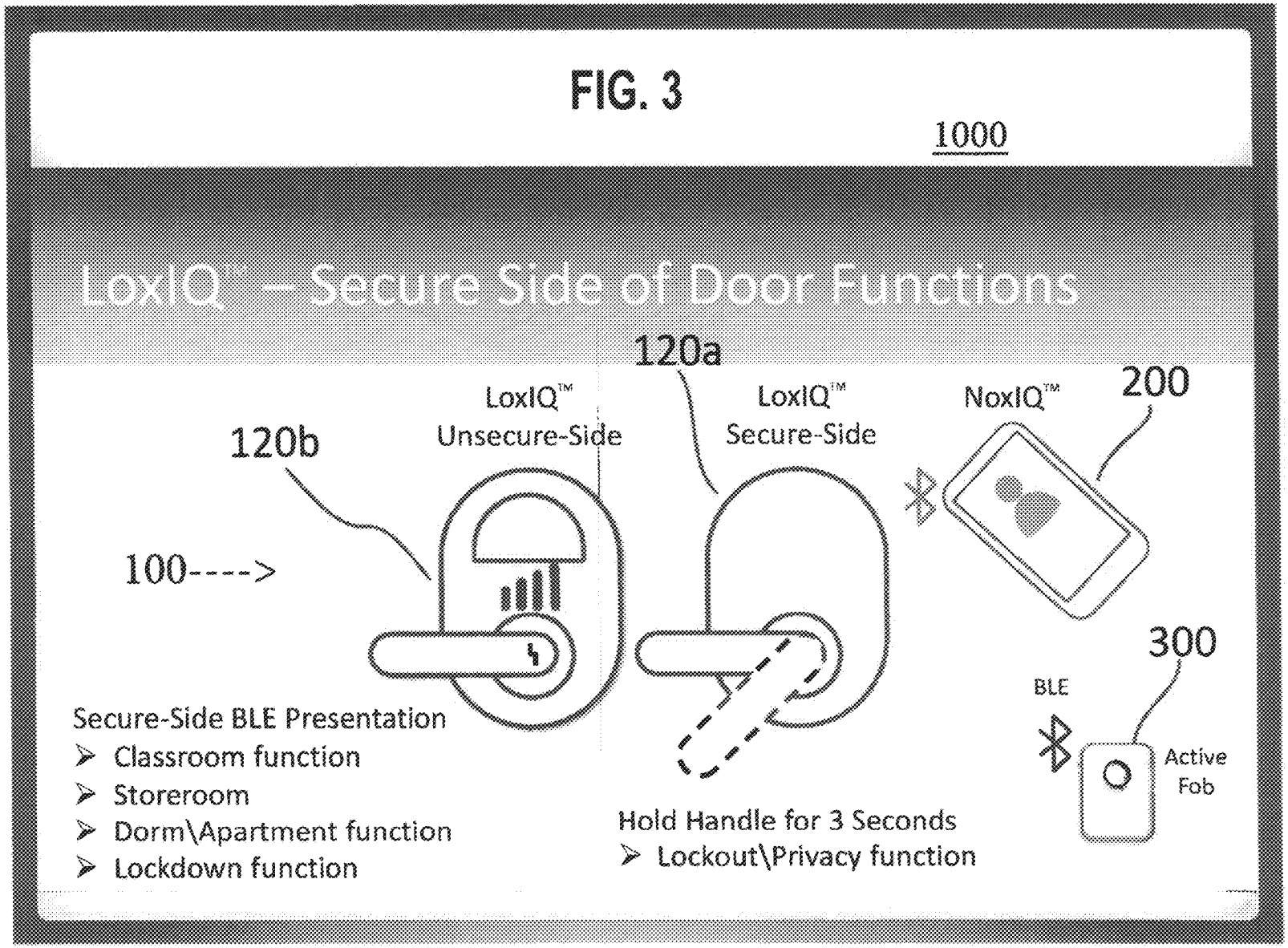
FIG. 3 illustrates a system 1000 to perform a lockdown of a door, according to an exemplary embodiment of the present general inventive concept.

FIG. 3 illustrates a system 1000 to perform a lockdown of a door, according to an exemplary embodiment of the present general inventive concept.

The system 1000 may include the lockset 100 having the interior handle 120*a* and the exterior handle 120*b*, a mobile device 200, and an electronic key 300, but is not limited thereto.

A mobile application may be provided on a mobile device 200, to allow for communication between the lockset 100 and the mobile device 200. More specifically, the mobile device 200 may communicate with the lockset 100 via WIFI, BLUETOOTH, Near Filed Technology, RFID, the Internet, or any other type of wireless communication known to one of ordinary skill in the art. Also, the mobile device 200 may be "paired" with the lockset 100, using BLUETOOTH technology, for example.

Hereinafter, reference to "lockdown functionality" of the lockset 100 may also include the lockdown functionality as described above with reference to FIGS. 1 and 2.

Referring to FIG. 3, the mobile application implemented on them mobile device 200 may allow a user to select a particular predetermined pattern, positioning, or timing of the interior handle 120*a* of the lockset 100 to activate the lockdown functionality of the lockset 100, thereby causing a lock, bolt, and/or latch of the lockset 100 to move from a locked position to an unlocked position. For example, when the user opens the application on the mobile device, such that it displays various options on a display unit thereof, the user may use the application to program the lockset 100 to require a 5-second hold-down of the interior handle 120*a* in a door-opening position, in order to cause the lockset 100 to initiate the lockdown functionality. Alternatively, the user may use the application to program the lockset 100 to require three pumps of the interior handle 120*a*, followed by a fourth pump including a 3-second hold-down of the interior handle 120*a* in order to cause the lockset 100 to initiate the lockdown functionality. However, these are just two examples, and many different combinations of interior handle 120*a* manipulation and hold-down timing of the interior handle 120*a* may be selected by the user.

For example, the application on the mobile device 200 may include a menu that allows users to select from different timing of the interior handle 120*a* to be held down in a door opening position, including, but not limited to, 3 seconds, 4 seconds, 5 seconds, 6 seconds, etc. The menu may also allow the user to select a predetermined number of times the interior handle 120*a* must be pumped in succession in order to initiate the lockdown functionality. Furthermore, the menu may allow a user to select a predetermined position where the interior handle 120*a* must be turned in order to initiate the lockdown functionality. Moreover, the menu may allow the user to combine the various different forms of interior handle 120*a* manipulation, similarly to a combination lock. Alternatively, the user may simply input words to describe the desired interior handle 120*a* manipulation sequence to perform the lockdown functionality.

The feature of the application allowing the user to choose a method of manipulating the interior handle 120*a* of the lockset 100 to perform the lockdown functionality, allows the user to set and reset the interior handle 120*a* manipulation method based on preference, necessity, or requirement. Also, in a school setting, a teacher may know the interior handle 120*a* manipulation method, while students will not know what pattern, positioning, or timing of the interior handle 120*a* manipulation will cause the lockdown functionality of the lockset 100 to initiate.

After the user uses the mobile application on the mobile device 200 to select a particular method of utilizing and/or manipulating the interior handle 120*a* of the lockset 100 to perform the lockdown functionality, the use may bring the mobile device 200 within a proximity of the locket 100 and press "send", for example, on the mobile device 200, to transfer signals with instructions to the lockset 100. As such, the lockset 100 may receive the instructions from the mobile device 200 regarding a specific interior handle 120*a* manipulation procedure required to initiate the lockdown functionality.

The mobile device 200 may include a cellular telephone, a laptop computer, a tablet computer, a desktop computer, a pocket organizer, or any other type of device that includes at least one of a processor, a storage medium, an input unit, a wired and/or wireless communication unit, and Internet connectivity.

The electronic key 300 may be a card, a FOB, a chip, or any other type of electronic key having a passive or active reader and/or transmitter. The electronic key 300 may be used to open the lock 110 of the lockset 100 without a need of a physical key.

However, if the lockset 100 is in a lockdown mode due to the lockdown functionality being activated, the electronic key 300 may not function to open the lock 110, and only the mobile device 200 may be used to override the lockdown mode. Alternatively, the lockset 100 may include a keypad to allow a user to enter a code to override the lockdown mode.

It should be noted that although the present general inventive concept includes descriptions of a mortise lock, any combination of the above embodiments may be used to perform lockdown functions of various different types of locksets not herein described herein, and the components and arrangements of the locksets described herein may be altered based on specific other types of locksets.

Other various embodiments of the present general inventive concept having a lockdown functionality of a lockset may also be provided. For example, in another exemplary embodiment, the lockset may be connected to a BLUETOOTH system that includes a BLE connected "bridge" or hub communicating from an Ethernet or RS485 connection to an off-line BLE wireless lock. As such, an administrator may initiate the lockdown functionality of the lockset remotely.

In yet another exemplary embodiment, an administrator or teacher may utilize an "active tag" (BLE or RFID) that operates similarly to an active tag for cars that locks and unlocks a car from up to 100 feet away. As such, the teacher or someone inside a classroom may lock a door from any location in a room to keep an intruder out of the classroom.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An electronic lockset mounted on a door, the electronic lockset comprising:

a lock comprising at least one of a latch bolt and a deadbolt to prevent the door from opening when the lock is in a locked state;

an interior handle to open the door when the lock is in an unlocked state;

a sensor to sense a manipulation of the interior handle;

a printed circuit board (PCB) to receive information sensed by the sensor regarding the manipulation of the interior handle; and a motor to move the at least one of the latch bolt and the deadbolt in response to a signal received by the PCB directed to the information regarding the manipulation of the interior handle.

2. The electronic lockset of claim 1, manipulation of the interior handle comprises at least one of the interior handle being turned and held for a predetermined time period, the interior handle being moved to a particular position, and the interior handle being turned a predetermined number of times in a particular sequence.

3. A system to perform a lockdown of a door, the system comprising:

an electronic lockset installed on the door, the lockset comprising a handle and at least one of a latch and a bolt; and a mobile device to communicate with the electronic lockset, such that the mobile device sends instructions to the electronic lockset to program the electronic lockset to lock the at least one of the latch and the bolt in response to a manipulation of the handle.

4. The system of claim 3, wherein the manipulation of the handle comprises at least one of moving the handle in a particular direction a predetermined number of times, holding the handle down in a door-opening position for a predetermined amount of time, and turning the handle to a particular position.

5. The system of claim 4, wherein the instructions are sent from the mobile device to the electronic lockset in response to the mobile device being brought within a predetermined proximity of the lockset.

6. An electronic lockset mounted on a door, the electronic lockset comprising:

a lock comprising at least one of a latch bolt and a deadbolt to prevent the door from opening when the lock is in a locked state;

an interior handle to open the door when the lock is in an unlocked state; and a motor to move the at least one of the latch bolt and the deadbolt from an unlocked position to a locked position in order to place the lock in the locked state in response to a manipulation of the interior handle.

7. The electronic lockset of claim 6, wherein the manipulation of the handle comprises at least one of moving the handle in a particular direction a predetermined number of times, holding the handle down in a door-opening position for a predetermined amount of time, and turning the handle to a particular position.

8. The electronic lockset of claim 6, further comprising:

a sensor to sense the manipulation of the interior handle; and a printed circuit board (PCB) to receive information sensed by the sensor regarding the manipulation of the interior handle and to send a signal to the motor corresponding to the received information.

9. The electronic lockset of claim 8, wherein the motor moves the at least one of the latch bolt and the deadbolt from the unlocked position to the locked position in response to the signal received from the PCB.

10. The electronic lockset of claim 9, wherein the manipulation of the handle comprises at least one of moving the handle in a particular direction a predetermined number of times, holding the handle down in a door-opening position for a predetermined amount of time, and turning the handle to a particular position.

* * * * *